United States Patent [19]

Kondo et al.

[11] Patent Number: 4,466,825

[45] Date of Patent: Aug. 21, 1984

[54] PROCESS FOR BLAST FURNACE OPERATION

[75] Inventors: Mikio Kondo; Kyoji Okabe, both of Chiba, Japan

[73] Assignee: Kawasaki Steel Corporaton, Kobe, Japan

[21] Appl. No.: 518,311

[22] Filed: Jul. 29, 1983

Related U.S. Application Data

[63] Continuation-in-part of Ser. No. 267,785, May 28, 1981, abandoned.

[30] Foreign Application Priority Data

May 30, 1980 [JP] Japan ..... 55-71414

[51] Int. Cl.[3] ..... C21B 5/00

[52] U.S. Cl. ..... 75/41

[58] Field of Search ..... 75/41

[56] References Cited

U.S. PATENT DOCUMENTS 4,315,771 2/1982 Bobillon ..... 75/41

*Primary Examiner*—Peter D. Rosenberg

*Attorney, Agent, or Firm*—Balogh, Osann, Kramer, Dvorak, Genova & Traub

[57] ABSTRACT

A process for operating blast furnaces is disclosed, which comprises assuming a plurality of reference spaces, each of which serves as a stacking space for burden material and is defined by a plurality of line segments having inclination angles $\theta_1$ and $\theta_2$ with respect to a horizontal line on a surface of a previously stacked burden, before a predetermined volume of the burden material is charged from a charging equipment; settling a newly stacked surface of the burden in one of the standard spaces in such a manner that the newly stacked surface consists of two line segments having inclination angle $\theta_1$ and $\theta_2$ with respect to the horizontal line and intersecting with a falling trajectory of the burden so that a space defined between the newly stacked surface and the previously stacked surface corresponds to the predetermined volume of the burden material; and then charging the predetermined volume of the burden material from the charging equipment up to the position of the newly stacked surface on the previously stacked surface.

4 Claims, 10 Drawing Figures

PROCESS FOR BLAST FURNACE OPERATION

This application is a continuation-in-part of application Ser. No. 267,785, filed May 28, 1981, and now abandoned.

This invention relates to a process for operating blast furnaces, and more particularly to a process for operating blast furnaces by previously estimating surface profile and layer thickness distribution of burden layer at the furnace top from planned physical properties of burden material before the charging, furnace planned operational condition, charging conditions and the like to hold the layer thickness distribution at an optimum state.

In general, the burden distribution at the top of the blast furnace are influenced by various factors complicatedly entangled with each other, typical examples of which are as follows:

(1) Physical properties of burden material such as density, grain size, inner friction coefficient and so on;
(2) Charging speed;
(3) Charging conditions such as coke base, ore/coke ratio (hereinafter referred to as O/C), stock line level and so on;
(4) Falling trajectory of burden flow, which is fundamentally influenced by a notch position of a movable armor in a bell-type blast furnace or a tilting angle of a distributing chute in a bell-less top blast furnace;
(5) Charging sequence; and
(6) Gas flow rate in furnace.

Besides, a geometrical arrangement between the throat of the furnace and the port of the charging equipment is considered to be a fundamental factor in the formation of burden distribution, but it is not an operational factor in the specified blast furnace. Therefore, when the burden is charged into the blast furnace through the charging equipment, the burden distribution is determined under an influence of the above mentioned factors. Particularly, layer thickness distribution and particle size distribution of the burden in the radial direction of the furnace are significant in order to achieve the reduction of fuel rate and the stabilization of furnace operation.

In the conventional operation of blast furnaces, the concept for controlling the burden distribution is based on the control of the layer thickness distribution and lies in an optimization of O/C radial distribution measured from a thickness ratio of ore layer to coke layer ($L_o/L_c$) or a product of this ratio with a bulk density ratio ($\rho_o/\rho_c$). For instance, it is known from experience that when the horizontally sectional area of the throat in the blast furnace is equally divided into a central part (CE), a middle part (M) and a peripheral part (P), if the relation of the layer thickness ratio ($L_o/L_c$) in these parts is given by the following equation (1):

$$(L_o/L_c)_M > (L_o/L_c)_P > (L_o/L_c)_{CE} \quad (1),$$

the stable operation with low fuel ratio can be achieved. However, the optimum layer thickness distribution is different in every furnace according to the profile of the blast furnace and is further changed even by the alteration of operational conditions, the selection of raw materials and the like. In order to follow this change, it is required to always hold the layer thickness distribution at an optimum state by a combination of operable factors among the aforementioned factors. The physical properties of the burden material and the gas flow rate in furnace are restricted by the raw material composition plan and production plan prior to the control of burden distribution, so that the above items (2), (3), (4) and (5) are main operational factors, which are alterable by the operators. Among these factors, the items (4) and (5) are particularly included in a charging pattern, a detail of which will be described below. In a bell-type blast furnace equipped with a movable armor, an example of the charging sequence for batches is shown by $C_3 \downarrow C_5 \downarrow O_1 \downarrow O_3$, which means that a first batch of coke is charged at a notch position 3 of the armor, a second batch of coke is charged at a notch position 5 of the armor, a first batch of ore is charged at a notch position 1 of the armor and a second batch of ore is charged at a notch position 3 of the armor. On the other hand, in a bell-less top blast furnace, an example of the charging sequence for batches is shown by C-1112223344679, O-111222334455, which means that one batch of coke is charged by 13 rotations of the distributing chute and one batch of ore is charged by 12 rotations of the chute and also the tilting position of the chute per batch is shifted according to the order shown by the above series of numerals. In short, the charging pattern defines the amount of burden material, the charging position and the charging order.

In the actual furnace operation, the gas temperature in the furnace and the radial distribution of the gas composition as measured by using an above-burden probe or an in-burden probe have been used as an index or a direct object for the control of the burden distribution. Lately, the layer thickness distribution also serves as a control object with the development of layer thickness measurement and apparatus therefor. In this connection, there are an indirect method and a direct method for the measurement of layer thickness. The former is a method wherein the profile of burden surface before and after the charging is measured by a transversally movable sounding device or a device using microwave or laser so as to determine the layer thickness difference, while the latter uses an electrode or a magnetic sensor. In case of using the indirect method, the measurement of burden surface profile can be performed in a relatively high accuracy. When ore is particularly piled on coke layer, however, this coke layer flows into the central part of the furnace, so that the level difference of burden surface before and after the charging as a layer thickness is estimated to be lower at the peripheral part of the furnace and higher at the central part thereof than the actual layer thickness. Therefore, it is required to take some correction, but there is found no proper correction means at present.

On the other hand, the direct method is only used for locally measuring the layer thickness near the furnace wall or the like in view of the use life or reliability of the measuring device, because the measuring device is very difficult to be put into practical use for measuring the layer thickness over a whole area in the radial direction of the furnace. Further, the measuring accuracy is poor owing to the presence of a mixed layer formed between the ore layer and the coke layer.

Viewing the actual control of burden distribution in the bell-less top blast furnace, significant alteration of the charging conditions including the charging pattern has a large influence on a total result in the blast furnace operation, so that it is a common sense to gradually put the burden distribution close to the optimum state by the repeat of narrow staged alterations in the charging conditions. For instance, it is usually performed to select the charging pattern so that only the tilting position of the distributing chute in the specified rotation numbers per batch is altered only by 1 at any tilting point. A concrete example of such a selection is shown as follows:

| | | | |
|---|---|---|---|
| Before alteration | C-11 | ① | 2 2 2 3 3 4 6 7 9, 0 - 1 1 1 2 2 2 3 3 4 4 5 5 |
| | | ↓ | |
| After alteration | C-11 | ② | 2 2 2 3 3 4 6 7 9, 0 - 1 1 1 2 2 2 3 3 4 4 5 5 |

In this case, however, if the various conditions other than the charging pattern are the same, the change of layer thickness distribution is very small, which is hardly distinguished by the actual measuring method. If the difference of layer thickness distribution is observed by the actual measuring method, such a difference must be considered to be based on the measuring error or an indetectable condition fluctuation. Of course, the actual measuring method confirms the effect by the large alteration of the charging conditions, and is rather more effective for the detection of disturbance factor than for the layer thickness measurement itself.

If it is intended to alter the charging conditions for the improvement of burden distribution, it is necessary to determine or plan a combination of operable conditions, but such a determination usually depends upon the past experiences and results. However, inexperienced ranges of the charging conditions must be often put in practice in order to pursue the optimum burden distribution. Therefore, since the effect by the alteration of the charging conditions is first confirmed only after the alteration, and execution of the charging conditions, the furnace operation based on only the actual measuring method is risky.

For this reason, it is important in the blast furnace operation that even if the alteration of each charging condition is too small, the effect of this alteration on the burden distribution or layer thickness distribution can previously be estimated. In the actual operation of blast furnaces, therefore, it is preferable that the burden distribution reaches an optimum state in a short time and held at this state by planning and estimating the effect resulting from the alteration of the charging conditions and by actually confirming the action of disturbances in the actual executed operation.

The invention is based on the above fact and is to provide the procedures for operating blast furnaces according to results obtained by previously planning and estimating effects based on the alteration of the charging conditions or more specifically, by previously simulating the burden distribution for the altered or planned combination of charging conditions.

That is, according to the invention there is the provision of a process for operating blast furnaces, in which procedures of charging burden materials into a blast furnace are periodically repeated for every cycle of batches within which combinations of charging conditions such as kind of burden material, weight and volume of burden material, stock line level, and either movable armour position or rotating velocity and tilting angle of a distributing chute, make a round and a burden distribution is controlled by planning and executing combinations of charging conditions contained in a cycle of batches, which process includes:

(a) simulating the burden distribution for a planned combination of charging conditions in the following manner before executing the same:

calculating a falling trajectory of a burden material for the planned combination of charging conditions before a volume of the burden material is charged into a blast furnace;

assuming that a surface of the burden material in the furnace has an angle of inclination $\theta_1$ in the furnace center side and another one $\theta_2$ in the furnace wall side with respect to a horizontal plane, and that the falling trajectory of the burden material collides against a bending position of the surface of the burden material, and calculating a level of the surface of the burden material according to the volume of the burden material for the planned combination of charging conditions;

(b) repeating the above-mentioned simulation in regular order of charging sequence from a first combination of charging conditions to a last one;

(c) estimating a total of the simulated burden distributions for the combinations of charging conditions; and (d) executing the planned combination of charging conditions based on the results obtained in the simulating, repeating and estimating steps, so as to control and always hold the burden distribution at an optimum state.

In particular, the simulation of the burden material step includes assuming a plurality of reference spaces, each of which serves as a stacking space for burden material and is defined by a plurality of line segments having inclination angles $\theta_1$ and $\theta_2$ with respect to a horizontal line on a surface of a previously stacked burden, before a predetermined volume of a burden material is charged from a charging equipment; and settling a newly stacked surface of said burden in one of said reference spaces in such a manner that the newly stacked surface consists of two line segments having inclination angles $\theta_1$ and $\theta_2$ with respect to the horizontal line and intersecting with a falling trajectory of the burden so that a space defined between said newly stacked surface and the previously stacked surface corresponds to the predetermined volume of said burden, whereby a burden distribution in the radial direction of the furnace is simulated and estimated for the furnace operation.

The invention will now be described in detail with reference to the accompanying drawings, wherein.

Figure 9:
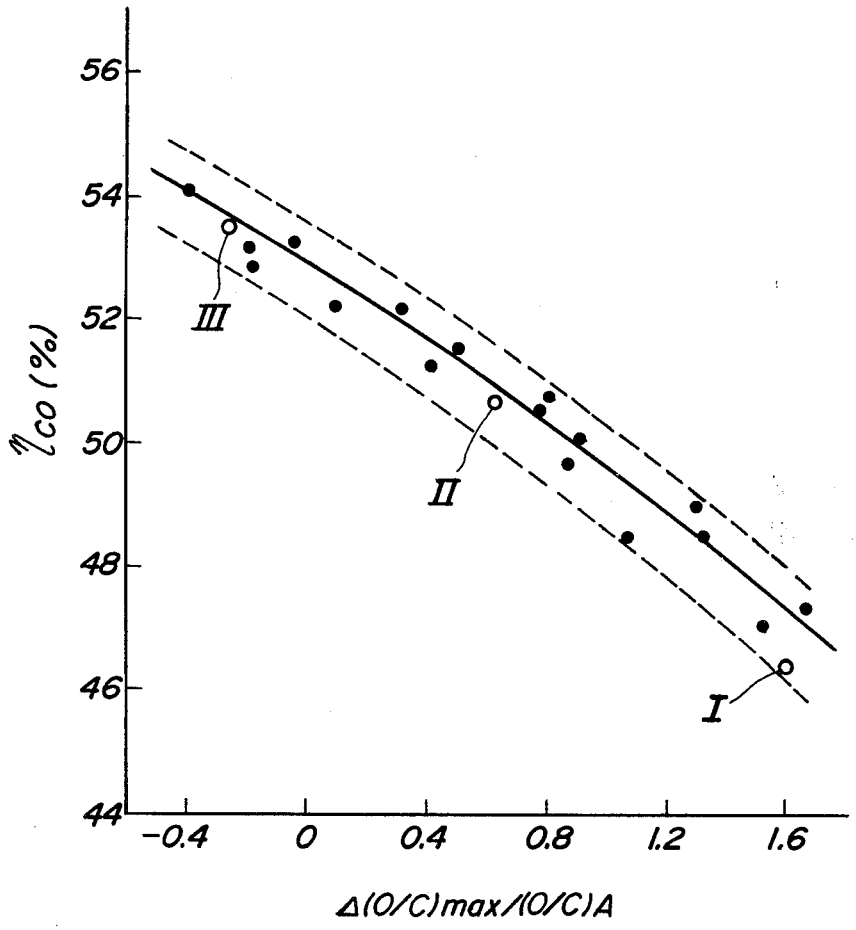
Figure 10:
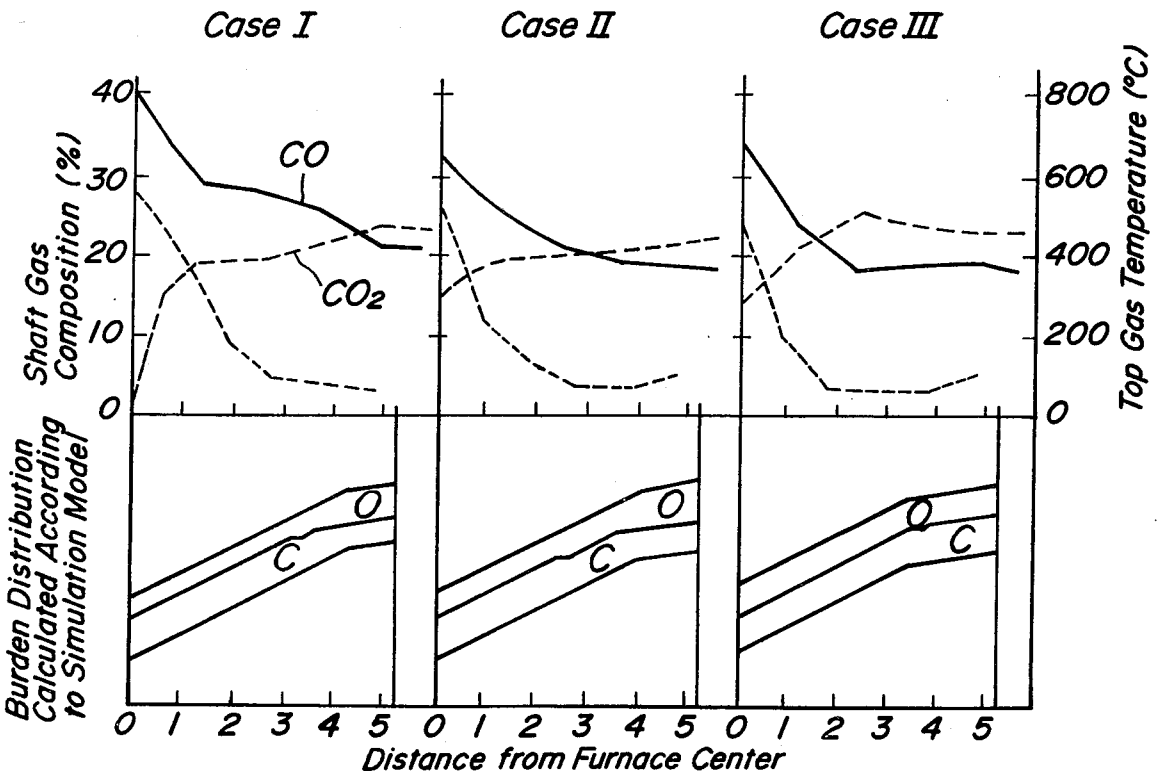

FIG. 9 is a graph showing a relation between $\Delta(O/C)max/(O/C)_A$ as an index of the burden distribution calculated by the process of the invention and the found value of CO gas utilization $\eta_{co}$ in furnace top gas; and FIG. 10 is a graph showing a relation between the found values of shaft gas composition and top gas temperature distribution for the alteration of the charging pattern according to the burden distribution measured by the process of the invention.

Figure 1:
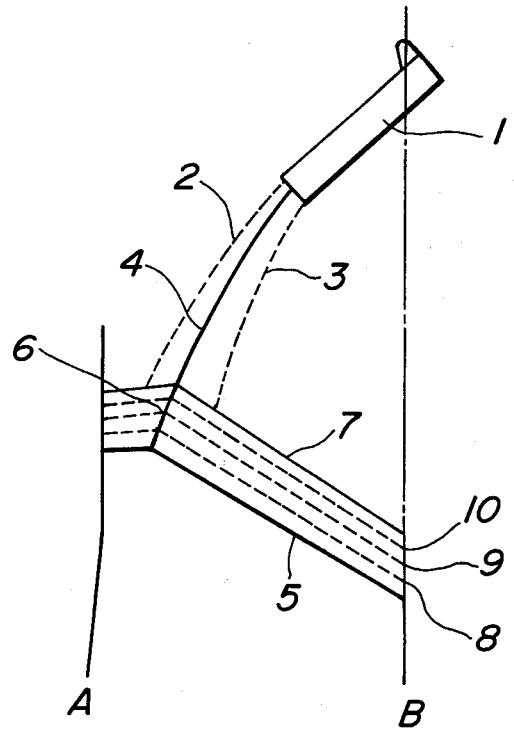
FIG. 1 is a diagrammatic view illustrating a stacked state of a burden charged in a top of a blast furnace.

At first, a stacked state of a burden layer charged from the charging equipment is shown in FIG. 1, wherein the symbol A represents the wall of the furnace and the symbol B represents the center of the furnace. Particularly, FIG. 1 shows the stacked state of the burden under such specified charging conditions that each of coke base, ore/coke ratio, stock line level and notch position of armor (bell-type) or tilting position of distributing chute (bell-less type) is a predetermined value. As shown in FIG. 1, the burden flow discharged from the charging equipment 1 falls in a space defined by upper side 2 and lower side 3 of the falling trajectory and comes into collision with the surface 5 of previously charged burden or a previously stacked surface 5. In this case, when the profile of burden distribution is M-shape as shown in FIG. 1, a peak 6 of the burden distribution is formed along a main flow 4 of the falling burden, where the burden flow 4 is divided into a stream directing to the furnace center B and a stream directing to the furnace wall A to produce a newly stacked surface 7. Since the profile of the burden distribution is generally M-shape, V-shape distribution is considered to be one of the specific types of the M-shape distribution wherein the position of peak 6 is shifted near the furnace wall A. Therefore, it is sufficient to observe the stacked state of the burden by the M-shape profile as shown in FIG. 1.

Moreover, the profile of the newly stacked surface 7 depends upon not only the above mentioned charging conditions but also the previously stacked surface 5. However, when the charged volume per batch is sufficiently large, the profile of the newly stacked surface 7 takes a certain shape without the influences by the profile of the previously stacked surface 5. On the other hand, if the charged volume per ring charge is small, the profile and level of the newly stacked surface 7 vary with the charged volume and shift in the order of dotted lines 8, 9 and 10 shown in FIG. 1 with the increase in the charged volume. In general, the charging conditions are altered by the notch position of the movable armor in case of the bell-type blast furnace or by the tilting position of the distributing chute in case of the bell-less top blast furnace. For instance, the alteration of the charging conditions is carried out at 4 times in the charging sequence of $C_3 \downarrow C_5 \downarrow O_1 \downarrow O_3 \downarrow$ for the bell-type blast furnace or at 12 times in the charging sequence of C-1112223344679, O-111222334455 for the bell-less top blast furnace. That is, the charged volume at the same notch position or tilting position is usually small.

Furthermore, in order to improve the furnace performances and optimize the furnace operation, the alteration of the charging pattern is frequently performed and periodically repeated in the usual operation for blast furnaces. Therefore, in order to judge the propriety of the charging pattern, there must exactly be estimated the surface profile and the layer thickness distribution of the burden obtained by the totalization of stacked surfaces according to this charging pattern.

The stacked state of the burden is shown as follows.

Figure 2:
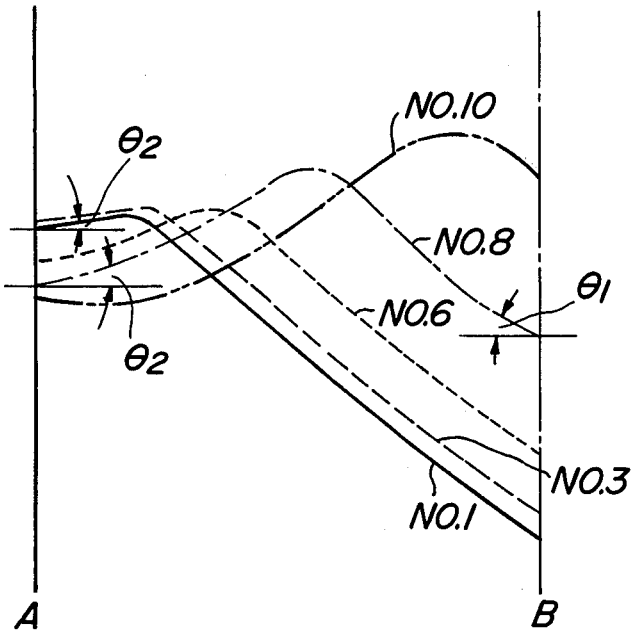
FIG. 2 is a diagrammatic view illustrating a surface profile of a burden layer according to a single ring charging in a bell-less top blast furnace.

That is, the surface profile of the burden layer by single ring charging in the bell-less top blast furnace is shown in FIG. 2. The term "single ring charging" used herein means a method of continuously charging the burden from the distributing chute at the same tilting position, so that a charging method using n tilting positions is called as n-multi ring charging. Therefore, in order to consider the final stacked state according to a certain charging pattern, it is necessary to know the stacked state by the single ring charging. As a result of various investigations with respect to the single ring charging, it has been found that an inclination angle $\theta$ of the V-shaped burden layer at the central part of the furnace with respect to a horizontal line is substantially equal independently of the change of the tilting position as shown in FIG. 2 (the increase in tilting position number shown in FIG. 2 is related to the decrease in the tilting angle of the chute). On the other hand, an inclination angle $\theta_2$ increases with the increase in the tilting position number at a part lying between the peak of the burden and the furnace wall A or a peripheral part of the burden layer. The latter case means that the inclination angle $\theta_2$ of the peripheral part is subjected to an influence of wall effect.

Figure 3:
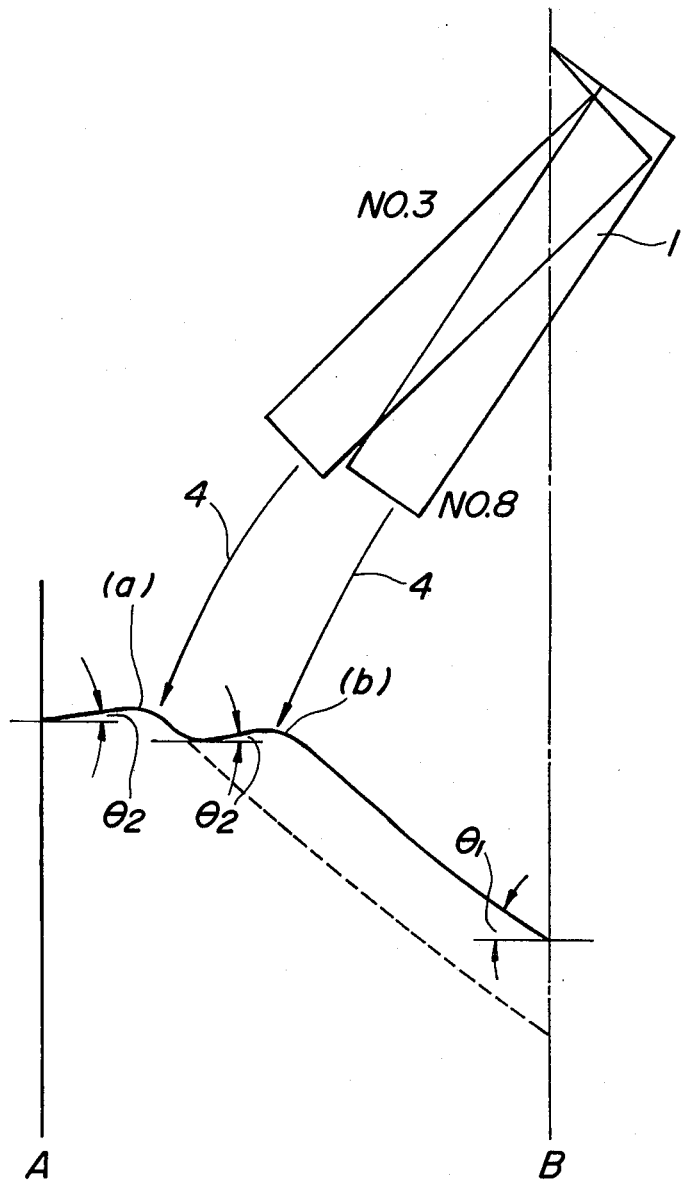
FIG. 3 is a diagrammatic view illustrating a surface profile of a burden layer according to a double ring charging in the same furnace as used in FIG. 2.

Considering such a wall effect, the burden is discharged from the distributing chute by double ring charge as shown in FIG. 3, wherein a first ring charge (a) is performed near the furnace wall A at the tilting position No. 3 and a second ring charge (b) is performed near the center at the tilting position No. 8. At the double ring charging of FIG. 3, the inclination angle $\theta_2$ at the tilting position No. 8 is fairly small as compared with the case of the single ring charging of FIG. 2 and is substantially equal to the value at the tilting position No. 1 of the single ring charging (see FIG. 2). From this fact, it is understood that in case of the double ring charging, the surface of the burden formed by the first ring charge plays the same roll as the furnace wall for the first ring charge.

The bell-less top is capable of producing any burden distributions, but the profile of the burden distribution is limited to a certain extent in order to realize the operation results of a desired degree or more. Actually, a V-shaped distribution having a flat part of the surface profile at its periphery or a M-shaped distribution having a narrow peripheral part is required for the normal operation. Therefore, when a M-shaped distribution is extreme as shown for the tilting position Nos. 6, 8 and 10 of FIG. 2, the normal operation for blast furnace cannot be expected.

In case o the multi ring charging, the stacking of the burden per ring charge is always subjected to the wall effect by the furnace wall and the previously stacked surface. Therefore, the newly stacked surface produced by each ring charge is characterized by the fact that it has a bending position point or peak on the falling trajectory, a large inclination angle $\theta_1$ in the central part and a small inclination angle $\theta_2$ in the peripheral part, which have the same tendency irrespctive of the tilting position.

With the foregoing in mind, according to the invention, a plurality of reference spaces, each of which serves as a stacking space for burden and is defined by a plurality of line segments having inclination angles $\theta_1$ and $\theta_2$ with respect to horizontal line on a surface of previously stacked burden are first assumed before a predetermined volume of a burden material is charged from a charging equipment. Then, by comparing the predetermined volume of the burden with a volume of each of the reference spaces, a newly stacked surface of the burden is estimated to be settled in one of these reference spaces in such a manner that the newly stacked surface consists of two line segments having inclination angles $\theta_1$ and $\theta_2$ with respect to horizontal line and itersecting with a falling trajectory of the burden so that a space defined between the newly stacked surface and the previously stacked surface corresponds to the predetermind volume of the burden.

Figure 4:
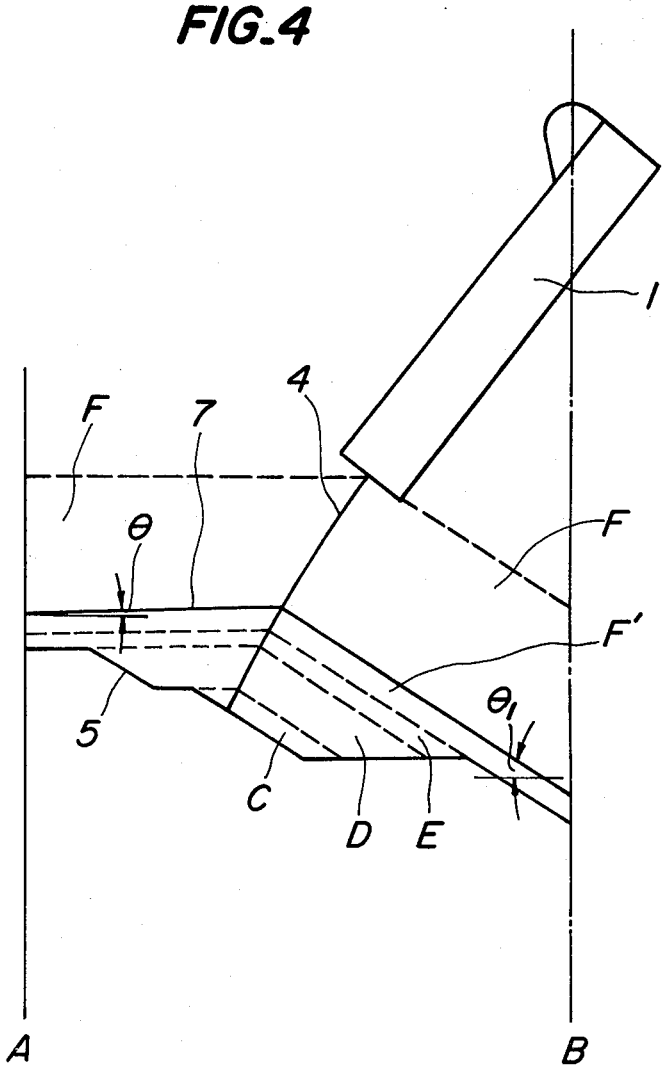
FIG. 4 is a diagrammatic view of a model assuming the successive stacked state of the burden charged under constant charging conditions as individual reference spaces.

In FIG. 4 is shown a stacking state of the burden under constant charging conditions. The final burden distribution defined for a charging pattern on the basis of the above mentioned feature of burden stacking behavior can be estimated according to a simulation model characterized by successively stacking procedures of burden for every given charging condition one upon the other as shown in FIG. 4.

The use of the simulation model (or simulation technique) for estimating the burden stacking behavior (or distribution) involves, therefore, the repeating of simulation for every given or planned charging condition (or combination thereof) in regular order of charging sequence from an initial charging condition (or combination thereof) to the last one.

That is, the newly stacked surface consists of two straight lines having an intersection on the falling trajectory, one of which has a gradient of tan $\theta_1$ and the other of which has a gradient of tan $\theta_2$ as geometrically seen from the above behavior. On the other hand, the previously stacked surface 5 is generally shown by such a shape that more than two straight line segments having either of two different gradients which alternately intersect with each other. Now, if it is intended to charge a burden of a volume V ($M^3$) from a distributing chute at a particular tilting position, a stacking space for this burden can be divided by the extension lines of the previously stacked surface 5 into the reference spaces C, D, E and F, provided that the reference space F means a whole region above the reference sapce E. Then, volumes $V_C$, $V_D$, $V_E$ and $V_F$ are calculated with respect to the reference spaces C, D, E and F, respectively.

Figure 5:
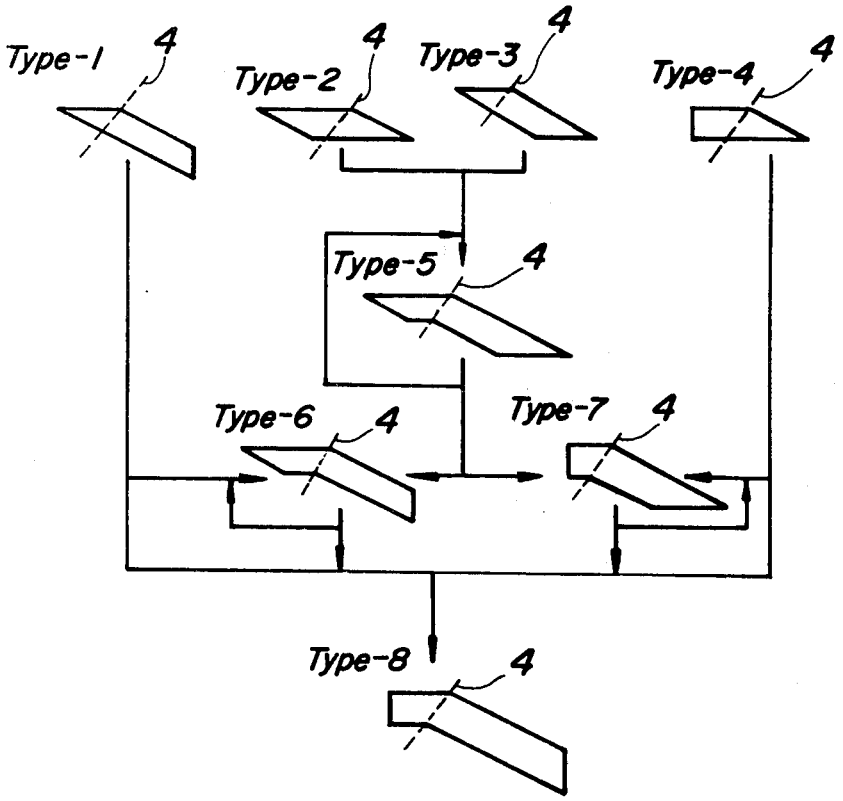
FIG. 5 is a diagrammatic view illustrating the shape of the stacked pattern shown by the reference space of FIG. 4 and the order of its occurrence.

When comparing the actual charged volume V with the volume $V_C$ of the lowest layer, if $V>V_C$, the final burden distribution defined for the charging pattern will extend to the reference space D, E or F over the reference space C. If $V<V_C$, the newly stacked surface is formed in the reference space C, so that the shape of space C' satisfying $V=V_C$ can be obtained by calculation to determine the newly stacked surface. In FIG. 4 is shown such an embodiment that the burden distribution extends from the reference space C to the reference space F. In this case, since $V>V_C+V_D+V_E$ and $V<V_C+V_D+V_E+V_F$, and a space F' satisfying $V=V_C+V_D+V_E+V_{F'}$ is existent in the reference space F, whereby the newly stacked surface 7 is determind. Moreover, a sectional shape of each of the reference spaces C, D, E and F (hereinafter referred to as a stack pattern) can take any one of geometrical shapes as shown in FIG. 5, wherein the occurrence order from the lower layer to the upper layer is indicated by an arrow. When the type of the stack pattern is expressed by numerals as shown in FIG. 5, the occurrence order of the stack pattern in the embodiment of FIG. 4 is Type-3→Type-5→Type-7→Type-8. However, this order can be derived from an infinite combination of stack pattern types, which is determined by the falling trajectory, the profile of the previously stacked surface and the charged volume.

In order to determine the newly stacked surface, it is preferable to calculate the burden distribution according to the following equations (2)–(15) by means of an electronic computer or the like. In FIG. 5, the most general stack pattern is Type-5 and other types for the stack pattern can be considered to be specific types of Type-5 as mentioned below. Now, suppose the newly stacked surface in FIG. 4 be existent in the reference space D corresponding to the stack pattern of Type-5, i.e. $V_C<V<V_C+V_D$.

In the calculation of the volume of the burden layer, assuming that the blast furnace is a cylindrical container, there is used a cylindrical coordinate system wherein a height measured from a particular level (this level may optionally be set) to an optional point is H (m) and a distance measured from the furnace center to an optional point is r (m).

Figure 6:
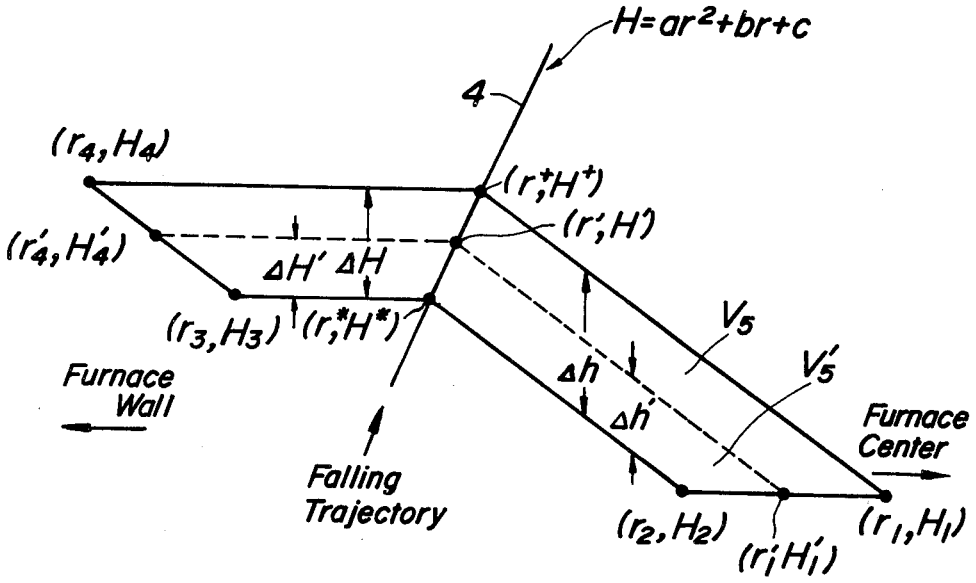
FIG. 6 is a diagrammatic view illustrating the coordinate at each end point, layer thickness and volume in the fundamental stacked pattern among the patterns of FIG. 5.

In the stack pattern of Type-5, when the coordinates of each end point is given by ($r_i$, $H_i$), ($r^*$, $H^*$) and ($r^+$, $H^+$), wherein i is 1 to 4, as shown in FIG. 6, a volume $V_5$ ($m^3$) of the stack pattern Type-5 can be calculated by the following equation (2):

$$\begin{aligned} V_5 &= \pi(\Delta H)R^2+\tfrac{1}{3}\pi(\mu_1-\mu_2)\{(r^*)^3-(r^+)^3\} \\ &-\{\pi(\Delta H)(R^2-r_4^2)+(\pi/3)(\mu_1-\mu_2)(r_4-r_3)^2(2r_4+r_3)\} \\ &-\{\pi(\Delta h)r_1^2+(\pi/3)(\mu_1-\mu_2)(r_2r_1)^2(r_2+2r_1)\} \end{aligned} \quad (2)$$

wherein $\pi$ is the circular constant, $\mu_1$ is tan $\theta_1$, $\mu_2$ is tan $\theta_2$, R is throat radius, $\Delta H$ is layer thickness on the furnace wall side and $\Delta h$ is layer thickness on the furance center side.

Assuming that the newly stacked surface is given by a plane connecting three points ($r'_1$, $H'_1$), ($r'$, $H'$) and ($r'_4$, $H'_4$) as shown by dotted lines in FIG. 6, a stacked volume $V'_5$ in the reference space D must satisfy the following equation (3):

$$V=V_C+V'_5 \quad (3)$$

$V'_5$ can be calculated by replacing $\Delta H$ on the right-hand side of the equation (2) with $\Delta H'$, but in this case, it is necessary to set the coordinates of the above three points and $\Delta h'$. They are functions of $\Delta H'$ and are given by the following equations (5)–(14). Moreover, the falling trajectory is given by the following equation (4).

$$H=ar^2+br+c \quad (4)$$

$$r'=(-P_1+\sqrt{P_2})/(2\times a) \quad (5)$$

$$H'=\mu_2\times r'+b_L \quad (6)$$

$$P_1=b-\mu_2 \quad (7)$$

$$P_2=(P_1)^2-4a(c-b_L) \quad (8)$$

$$b_L=H^*+(\Delta H')-\mu_2\times r^* \quad (9)$$

$$\Delta h'=\mu_1(r^*-r')+(H'-H^*) \quad (10)$$

$$r'_1=r'_2-(\Delta h')/(\mu_1-\mu_2) \quad (11)$$

$$H'_1 = -\mu_2(r_2 - r'_1) + H_2 \quad (12)$$

$$r'_4 = r_3 + (\Delta H')/(\mu_1 - \mu_2) \quad (13)$$

$$H'_4 = \mu_1(r'_4 - r_3) + H_3 \quad (14)$$

In the equations (4)-(14), only $\Delta H'$ is an unknown quantity and other parameters are known. As apparent from FIG. 4, the coordinates ($r^*$, $H^*$) are given as the coordinates of the intersection of the previously stacked surface itself with the falling trajectory or those of the intersections of the extension line of the previously stacked surface with the falling trajectory, while the coordinates ($r_2$, $H_2$) and ($r_3$, $H_3$) are given as the coordinates of the bend points on the previously stacked surface or the coordinates at the intersections of the previously stacked surface with lines drawn from the point ($r^*$, $H^*$) parallel to the previously stacked surface. These coordinates can easily be calculated from the previously stacked surface and the falling trajectory, a detail of which is omitted herein. Furthermore, coefficients a, b and c of the falling trajectory equation and $\mu_1$ and $\mu_2$ are the previously known numerical values Concretely, the value ($\Delta H'$) is determined by trial and error method according to the following equation (15) so as to satisfy the equation (3), which can easily be calculated by means of an electronic computer.

$$V'_5 = V - V_C = \pi(\Delta H')R^2 + \tfrac{1}{3}\pi(\mu_1 - \mu_2)\{(r^*)^3 - (r')^3)\} - [\pi(\Delta H')\{R^2 - (r'_4)^2\} + (\pi/3)(\mu_1 - \mu_2)\{(r'_4) - (r_3)\}^2\{2(r'_4) + r_3\}] - [\pi(\Delta h')(r'_1)^2 + (\pi/3)(\mu_1 - \mu_2)\{r_2 - (r'_1)\}^2\}r_2 + 2(r'_1)\}] \quad (15)$$

In case of the stack patterns other than Type-5, the equations (2)-(15) can also be applied with the specific conditions for the coordinates of the end points shown in the following Table 1.

TABLE 1

| Type of stack pattern No. | Specific conditions |
|---|---|
| 1 | $r_1 = r_2 = O$, $r_3 = r^*$ |
| 2 | $r_2 = r^*$ |
| 3 | $r_3 = r^*$ |
| 4 | $r_3 = r_4 = R$, $r_2 = r^*$ |
| 5 | general type |
| 6 | $r_1 = r_2 = O$ |
| 7 | $r_3 = r_4 = R$ |
| 8 | $r_1 = r_2 = O$, $r_3 = r_4 = R$ |

Then, the determination of the newly stacked surface as mentioned above is applied to the bell-less top blast furnace as follows.

Prior to successive calculation of newly stacked surface, the shape of early stacked surface is first assumed under the predetermined charging conditions, calculative parameters, $\theta_1$, $\theta_2$ and the like. This stacked surface may take any shape consisting of several straight lines having either of two different gradients of $\mu_1 = \tan\theta_1$ and $\mu_2 = \tan\theta_2$.

By using this stacked surface as a previously stacked surface, the calculation is started for a newly stacked surface in a first ring charge of a first batch. Then, this newly stacked surface is used as a previously stacked surface of next ring charge. In this way, the above calculation is performed up to the last ring charge of the last batch in a given charging sequence. In this case, the newly stacked surface at the completion of the calculation for every batch is located at a level higher than a given stock line level, so that it is shifted down to the stock line level and thereafter the calculation for next batch is started. Such a type of calculation is continued repeatedly for the cycle of batches. When the calculation for the last ring charge of the last batch is finished, the convergence condition for the calculated results is judged. It is based on the judgement whether all of calculated results for the charging pattern do not change any more with the iteration for the entire charging pattern. After the calculated burden distribution reaches a cyclic steady state, the layer thickness distribution and ore/coke distribution in radial direction are calculated, and the calculation is stopped.

Figure 7:
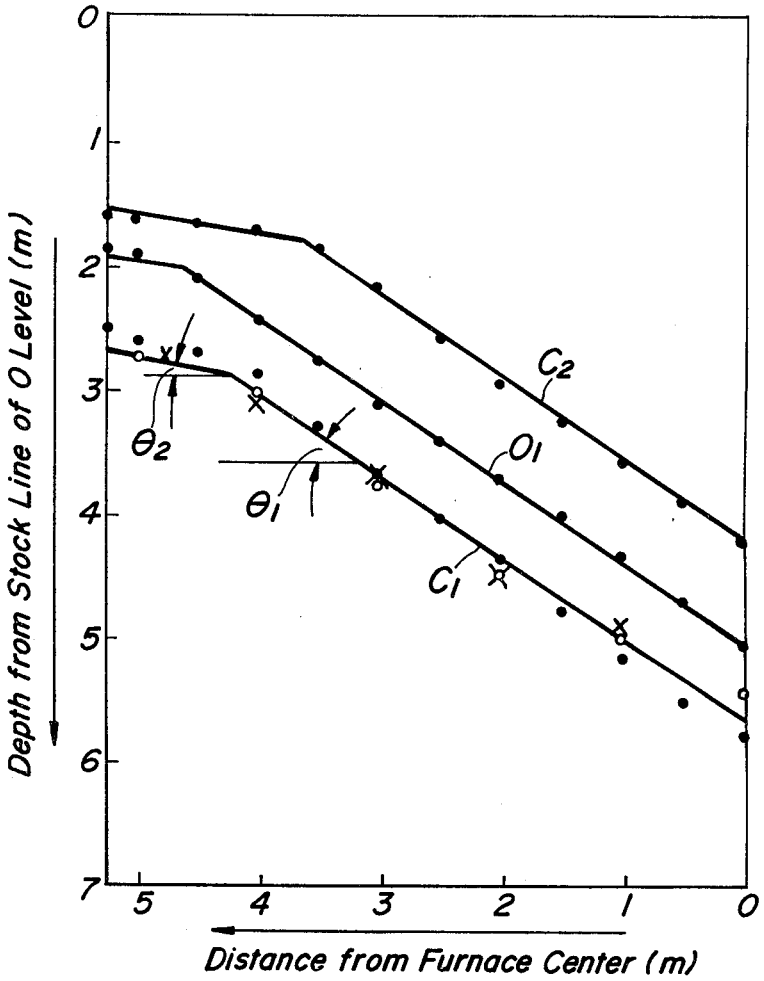
FIG. 7 is a graph showing a surface profile of a burden layer obtained by the process of the invention and a boundary between ore and coke in the burden.

In this connection, the calculated values of the newly stacked surface according to the above mentioned estimation of the invention is compared with the actual ones measured in the bell-less top blast furnace according to the charging sequence of $C_1$-223344556677, $O_1$-112233445, $C_2$-334455667788 as shown in FIG. 7, wherein each of solid lines $C_1$, $O_1$ and $C_2$ indicates a newly stacked surface for each batch estimated according to the invention and symbol represents the stacked surface measured at various radial positions just after the charging of each batch.

The inclination angle $\theta_2$ is 10° for both ore and coke layers, while the inclination angle $\theta_1$ is 33.5° for the ore layer and 36° for the coke layer. Now, when the ore layer is stacked on the coke layer, a part of the coke layer near the furnace wall is carried away toward the furnace center together with the ore flow, so that a gradient of a boundary surface between the ore layer and the coke layer becomes smaller than the gradient of the coke layer surface before the charging of ore and is substantially equal to that of the ore layer surface. This is confirmed from the boundary surface (symbol o) measured by using a layer thickness measuring device and that (symbol ×) by using samples of ore layer cemented with resin as shown in FIG. 7. Therefore, $\theta_1 = 33.5°$ and $\theta$hd $2 = 10°$ are applied to both the ore and coke layer.

From FIG. 7, it can be seen that the estimated results shown by the solid lines are in good agreement with the actually measured values and the profile and layer thickness distribution of the burden layer can be estimated by the process of the invention as mentioned above.

Figure 8:
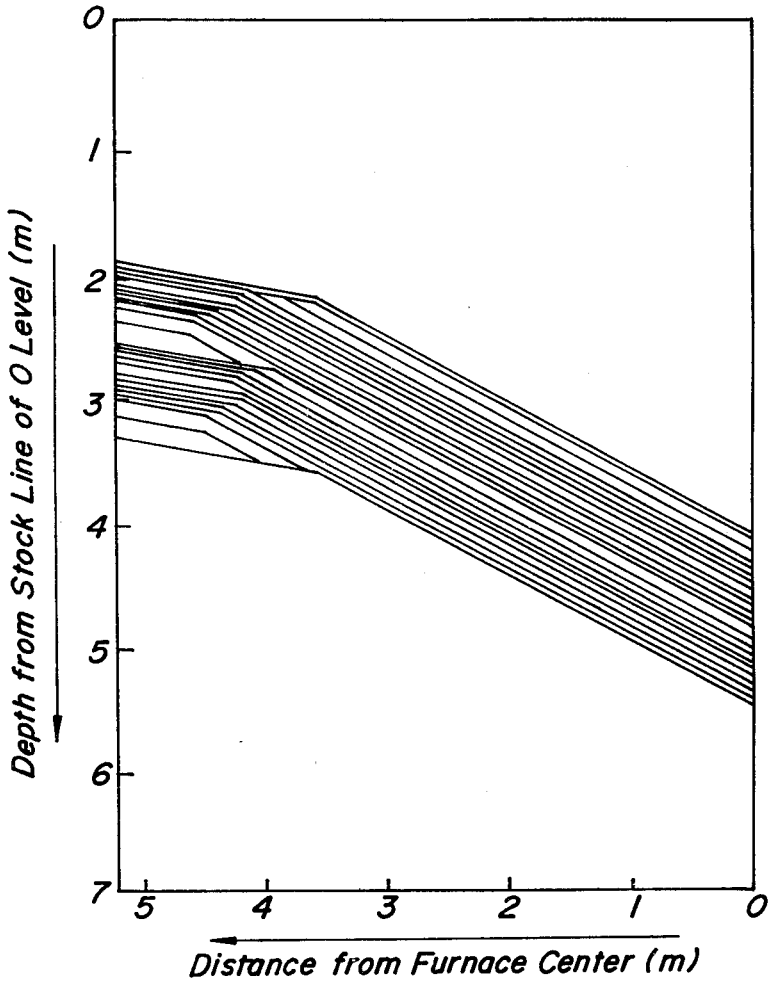
FIG. 8 is a graph showing an embodiment of multi stacked structure in the burden layer.

In FIG. 8 is shown a multi-layer structure which is obtained by piling the estimated surface of the layer for every rotation of the distributing chute one upon the other and shows a burden distribution at steady state. The charging sequence in FIG. 8 is C-1122333444567, O-1112233456777.

Then, the radial distribution of ore/coke is calculated from the results of the burden distribution in the radial direction of the blast furnace. In this case, let ore/coke in the furnace wall be $(O/C)_W$, ore/coke in the furnace center be $(O/C)_C$, maximum value of ore/coke in the region including peripheral and middle parts when the sectional area of the throat is equally divided into central part, middle part and peripheral part by MAX-$(O/C)_{P,M}$, and minimum value of ore/coke in central part be MIN$(O/C)_{CE}$. That is, the radial distribution of ore/coke is expressed as indices calculated from these values and predetermined ore/coke value $(O/C)_A$ according to the following equations (16)-(19):

$$(O/C)_W/(O/C)_A \quad (16)$$

$$(O/C)_C/(O/C)_A \quad (17)$$

$$\Delta(O/C)/(O/C)_A=\{(O/C)_W-(O/C)_C\}/(O/C)_A \quad (18)$$

$$\Delta(O/C)_{max}/(O/C)_A=\{MAX(O/C)_{P,M}-MINO/C)_{CE}\}/(O/C)_A \quad (19)$$

In general, the control of burden distribution aims at realizing the layer thickness distribution of the burden layer in the radial direction or the gas flow resistance distribution enough to provide a high utilization efficiency of a reducing gas for reduction reaction of ore when the reducing gas rising in the furnace comes into counter contact with the descending burden. The utilization efficiency of the reducing gas is usually evaluated by the following equation (20) from the gas composition at the furnace top after the completion of the solid-gas reaction:

$$\eta_{co}(\%)=CO_2(\%)/\{CO(\%)+CO_2(\%)\}\times 100 \quad (20)$$

In order to raise $\eta_{co}$, it is desirable to uniformalize the layer thickness distribution or the gas flow resistance distribution toward the radial direction of the furnace. However, the excessive uniformalization biases the gas flow toward the peripheral part of the furnace of produces a so-called excessive gas flow at the peripheral part, which is unfavorable in the blast furnace operation together with the excessive gas flow at the central part and decreases $\eta_{co}$. Therefore, it is necessary to optimize the layer thickness distribution for the improvement of $\eta_{co}$.

In this connection, it is desirable to indicate the layer thickness distribution in the radial direction as an index directly expressed by a single numerical value. For this purpose, the following indices are adopted in the invention.

(i) $(O/C)_W$: ore/coke in the furnace wall;

(ii) $(O/C)_W-(O/C)_A$: difference between $(O/C)_W$ and averaged value of (O/C) or predetermined (O/C) for one charge;

The increase in these indices (i) and (ii) indicates the center-working operation.

(iii) $(O/C)_C$: ore/coke at the furnace center;

(iv) $(O/C)_c-(O/C)_A$;

The decrease of these indices (iii) and (iv) indicates the center-working operation.

(v) $\Delta(O/C)=(O/C)_W-(O/C)_C$; (vi) $\Delta(O/C)_{max}=MAX(O/C)_{P,M}-MIN(O/C)_{CE}$;

These indices (v) and (vi) represent the scattering degree or uniformity of the layer thickness distribution, and the increase thereof indicates the center-working operation. In the calculation of $\Delta(O/C)_{max}$, the sectional area of the throat is equally divided into a central part (CE), a middle part (M) and a peripheral part (P), and let a maximum value of ore/coke in a local region extending from the middle part to the peripheral part be $MAX(O/C)_{P,M}$ and a minimum value of ore/coke in the central part be $MIN(O/C)_{CE}$.

Each value of the above indices is dependent upon $(O/C)_A$ or the predetermined ore/coke for one charge and is normalized as the following (viii)-(x):

(vii) $(O/C)_W/(O/C)_A$;

(viii) $(O/C)_C/(O/C)_A$;

(ix) $\Delta(O/C)/(O/C)_A$;

(x) $\Delta(O/C)_{max}/(O/C)_A$;

In this case, the normalized indices of (ii) and (iv) have the same meaning as the corresponding indices (vii) and (viii).

In the actual operation of the bell-less top blast furnace, the measured value of $\eta_{co}$ varies with $\Delta(O/C)_{max}/(O/C)_A$ of the index (x) to obtain a result as shown in FIG. 9. Each numeral of I, II and III in FIG. 9 represents each case shown in the following Table 2.

TABLE 2

| | Case I | Case II | Case III |
|---|---|---|---|
| Hot metal production (t/day) | 8992 | 9403 | 10144 |
| Agglomerated ore (%) | 80.0 | 82.7 | 89.5 |
| Blast volume ($Nm^3$/min) | 6661 | 6669 | 6885 |
| Blast pressure (g/$cm^2$) | 4175 | 4224 | 4366 |
| Blast temperature (°C.) | 1285 | 1253 | 1293 |
| Top pressure (g/$cm^2$) | 2310 | 2390 | 2500 |
| ΔP/V | 0.280 | 0.275 | 0.271 |
| $\eta_{co}$ (%) | 46.2 | 50.6 | 53.5 |
| $(O/C)_A$ | 3.80 | 3.96 | 4.08 |
| Fuel rate (kg/t-pig) | 472.3 | 455.1 | 436.0 |
| Coke rate (kg/t-pig) | 425.3 | 409.9 | 400.9 |
| Oil rate (kg/t-pig) | 47.0 | 45.2 | 35.1 |
| [Si] (%) | 0.51 | 0.45 | 0.31 |
| Hot metal temperature (°C.) | 1511 | 1512 | 1500 |
| Charging pattern coke | 344556677889 | 11122233446710 | 1122333444567 |
| ore | 1122334455 | 111222334455 | 1112233456777 |
| $\frac{\Delta(O/C)max}{(O/C)_A}$ | 1.60 | 0.638 | −0.253 |

The Case I shows a charging pattern directing to a center-working flow operation for preventing the temperature rising at the furnace wall with the sacrifice of low $\eta_{co}$ and fuel rate, in which the value of $\Delta(O/C)_{max}/(O/C)_A$ is made larger in order to increase the thickness of the ore layer near the furnace wall and suppress the peripheral flow. As a result, $\eta_{co}$ is as low as 46.2% and the fuel rate is about 470 kg/t-pig iron. Furthermore, the gas temperature is 35° C. near the furnace wall and is lowest as compared with the other cases as seen from the top gas temperature distribution shown by dotted lines in FIG. 10.

The case III shows a charging pattern directing to a periphery-working operation for the increase in $\eta_{co}$ and the reduction of the fuel rate, in which the layer thickness distribution in the radial direction is made uniform and the value of $(O/C)_W$ is made smaller than the value of $(O/C)_C$ to apparently make the value of $\Delta(O/C)_{max}/(O/C)_A$ negative. As seen from the distribution of shaft gas composition in FIG. 10, this case develops excellent effect based on the uniformalization of the layer thickness distribution in the radial direction. While, the content of CO gas (%, shown by solid line) is high in the central part of the furnace, $\eta_{co}$ is high in the middle and peripheral parts thereof. In this case, the reason why the peripheral flow is not excessive even under the condition of $(O/C)_W<(O/C)_C$ is based on the fact that the size of particles in the ore layer increases toward the central part of the furnace due to size segregation in radial direction. As a result, the central flow is hold in an appropriate range.

The case II is intermediate between the cases I and III and shows a charging pattern in the course of gradually increasing $\eta_{co}$ from the case I to the case III in compliance with the value of $\Delta(O/C)_{max}/(O/C)_A$.

Moreover, when the estimated burden distribution (C is coke layer and O is ore layer) is compared with the distribution of shaft gas composition in FIG. 10, it is understood that O/C in a region that $CO_2$ content (dot dash lines) is higher than CO content or a local region that $\eta_{co}$ is higher than 50% is approximately more than 3.5 in all of the three cases. In other words, the shaft gas composition can be anticipated from the estimated burden distribution.

As apparent from the above, the value of $\Delta(O/C)_{max}/(O/C)_A$ can be obtained from the previously estimated burden distribution, which shows the state of gas flow inside the furnace or the furnace operating state. Therefore, when the value of this index is changed in accordance with the furnace operating conditions, several charging patterns for such changed value can be proposed from the calculation of the relevant burden distribution. Because a large number of charging pattern can be put in practical use. One of them is properly selected in order to optimize the furnace operation. Then, the aforementioned indices (16), (17) and (18) are calculated by using the value of $\Delta(O/C)_{max}/(O/C)_A$ with an electronic computer according to relational expressions shown in the following Table 3. Moreover, the alteration of the charging pattern can be performed experimentally without using the calculated indices, but in this case the excessive degree of alteration may be often taken, which causes the fluctuation of furnace operation and takes a long time for improving the fluctuated furnace conditions. Therefore, it is preferably to gradually perform the alteration of the charging pattern according to the above calculation method.

TABLE 3

| y | x | Relational expression |
|---|---|---|
| $(O/C)_W/(O/C)_A$ | $\Delta(O/C)_{max}/(O/C)_A$ | $y = 0.122x^2 + 0.45x + 0.995$ |
| $(O/C)_C/(O/C)_A$ | " | $y = 0.0625x^2 - 0.456x + 0.985$ |
| $\Delta(O/C)/(O/C)_A$ | " | $y = 0.99x + 0.01$ |

In the actual operation, when a planned combination of charging conditions is executed (based on results obtained in the above-described estimation and calculation simulation method), the inclination angles $\theta_1$ and $\theta_2$ of burden layer at the furnace top are dependent upon the kind of the burden, particle size, moisture content, blast volume, top gas volume and charging conditions. $\theta_1$ is influenced by all of these factors, while $\theta_2$ is mainly influenced by the charging conditions.

The burden layer is subjected to a drag force corresponding to a pressure loss of a gas passing through the burden layer, so that the inclination angle of the burden layer is shifted from the original state in the absence of gas flow, and comes into equilibrium with a smaller angle. In other words, the inclination angle lowers with the increase in gas pressure loss as the burden particle size decreases or the gas flow rate increases. Considering such a phenomenon, the inclination angle of the central part having, for example, a V-shaped profile is so determined that the relationship among the drag force of the gas, the gravity of the burden and the shearing stress in the burden layer is in a so-called critical stress state. On the other hand, the peripheral part having a small inclination angle is not in the critical stress state, so that such an inclination angle is determined only by the movement of the burden at the charging without being influenced by the dynamic interaction between the gas flow and the burden layer.

Among the above factors influencing on the inclination angles $\theta_1$ and $\theta_2$, factors other than particle size and moisture content are operational factors determined by the operator's will, so that the effect of these factors on $\theta_1$ and $\theta_2$ can previously be anticipated. However, the particle size and moisture content is controlled to a certain extent but may not be controlled. They should be considered to be disturbance factors as far as the burden distribution is concerned.

The volume of the burden flow distributed on both central and peripheral sides divided by the falling trajectory in FIG. 6 varies with the change in $\theta_1$ and $\theta_2$. A relation between $\Delta H$ and $\Delta h$ defined in FIG. 6 is given by the following equation (20):

$$\frac{\Delta H}{\Delta h} = \frac{H'(r^*) - \mu_2}{H'(r^*) - \mu_1} \tag{20}$$

wherein $H'(r^*) = \frac{dH}{dr}\, r = r^*$.

As apparent from the above relation, even if all of the other operational factors are fixed, there is no guarantee that $\theta_1$ and $\theta_2$ are invariable. That is, the burden distribution changes with the change of $\theta_1$ and $\theta_2$ according to the equation (20). In this connection, the value of $\Delta(O/C)_{max}/(O/C)_A$ shown in FIG. 9 is calculated at $\theta_1 = 28°$ and $\theta_2 = 10°$ without considering the variable factors. In fact, the fluctuation of $\eta_{co}$ of 1.5 to 2.0% is observed for the same value of $\Delta(O/C)_{max}/(O/C)_A$. Such a fluctuation of $\eta_{co}$ is considered to result from the change of the disturbance factor on the inclination angle as well as the operational factors.

Fortunately, $\theta_1$ and $\theta_2$ are easily ascertained from the profile of the burden surface as measured by the use of a radially-movable sounding device or by an optical method using microwave or laser. Now, there will be described an embodiment that the result for the actual blast furnace operation is improved by utilizing the measured values of $\theta_1$ and $\theta_2$ to the simulation model and compensating the change of $\theta_1$ and $\theta_2$ with the alteration of the charging pattern to always maintain the burden distribution at a fixed state.

The profile of the burden surface is measured by means of a radially-movable profile-meter which is installed at a level above the burden and is equipped with a sounding device.

The following Table 4 shows the examples for the alteration of the charging pattern during 10 days of the working according to the invention. The action No. 2 is the case that the burden particle size is lowered by some reasons and has a tendency of periphery-working operation upon the continuation of the standard charging pattern. In this case, therefore, the index $\Delta(O/C)_{max}/(O/C)_A$ is returned to the original value by altering only the charging pattern for ore. On the other hand, the action Nos. 4 and 6 has a tendency of center-working operation and in these cases, the change of the burden distribution resulted from the operational factor is suppressed by altering only the charging pattern for ore or coke to control $\Delta(O/C)_{max}/(O/C)_A$. As a result, when the operational result according to the invention is compared with the operational result according to only the standard charging pattern without taking some procedure for the change of $\theta_1$ and $\theta_2$, the average value of $\eta_{co}$ is improved by 0.4% and the fluctuation of $\eta_{co}$ becomes smaller, which shows that the invention is effective for the control of the burden distribution.

TABLE 4

| Action No. | Disturbance factor or operational action | Found value of inclination angle $\theta_1$ | $\theta_2$ | $\Delta(O/C)_{max}/(O/C)_A$ Standard charging pattern | Charging pattern after alteration | Alteration of charging pattern |
|---|---|---|---|---|---|---|
| | | | | | | Standard charging pattern |
| 1 | Standard | 28 | 5 | −0.197 | | [ C 1112233445677, O 1112233456777 ] |
| 2 | Fluctuation of particle size and moisture content (Fluctuated amount is not clear) | 25 | 5.5 | −0.220 | −0.194 | O 1112233445677 |
| 3 | Return to standard | 28 | 5 | −0.197 | −0.197 | Standard |
| 4 | Reduction of blast volume (−5%) | 30.5 | 4.5 | −0.161 | −0.202 | C 1112233444567 |
| 5 | Return to standard (increase of blast volume, +5%) | 28 | 5 | −0.197 | −0.197 | Standard |
| 6 | Reduction of pellet ratio (6 → 1%) | 30 | 6 | −0.178 | −0.192 | O 1122334456777 |

The working of the invention: $\eta_{co}$ = 53.8% ± 0.3 (10 days)
Prior to the working of the invention
Standard charging pattern: $\eta_{co}$ = 53.4% ± 0.6 (10 days)

As previously mentioned in detail, the invention makes it possible to estimate the stacked state of the burden at the furnace top, i.e. surface profile and layer thickness distribution of the burden layer on the basis of the physical properties of the burden, furnace operating conditions and charging conditions before the burden is charged into the blast furnace, so that the charging method for optimizing the layer thickness distribution can quantitatively be examined and also the blast furnace operation can be controlled so as to always hold the burden distribution at an optimum state. As a result, the invention is considerably effective for the reduction of fuel rate and the stabilization of furnace operation in the blast furnace.

What is claimed is:

1. A process for blast furnace operation, in which procedures of charging burden material into a blast furnace are periodically repeated for every cycle of batches within which combinations of charging conditions such as kind of burden material, weight and volume of burden material, stock line level, and either movable armour position or rotating velocity and tilting angle of a distributing chute make a round, and a burden distribution is controlled by planning and executing combinations of charging conditions contained in a cycle of batches, which process comprises:

simulating the burden distribution for a planned combination of charging conditions in the following manner before executing them:

calculating a falling trajectory of a burden material for the combination of charging conditions before a volume of the burden material is charged into the furnace, assuming that a surface of the burden material in the furnace has an angle of inclination $\theta_1$ in the furnace center side and another one $\theta_2$ in the furnace wall side with respect to a horizontal plane, and that the falling trajectory of the burden material collides against a bending position of the burden surface; and calculating a level of the burden surface according to the volume of the burden material for the combination of charging conditions;

repeating the above-mentioned simulation in regular order of charging sequence from the first combination of charging conditions to the last one;

estimating a total of the simulated burden distributions for the combinations of charging conditions; and executing the planned combination of charging conditions based on results obtained from the simulating, repeating and estimating steps, so as to control and hold the burden distribution at an optimum state.

2. A process according to claim 1, wherein the burden distribution in the radial direction of the furnace is estimated, the process further comprising:

calculating from the estimated results of the burden distribution an index given by the following equation:

$$\Delta(O/C)_{max}/(O/C)_A = \{MAX(O/C)_{P,M} - MIN(O/C)_{CE}\}/(O/C)_A$$

wherein $MAX(O/C)_{P,M}$ is a maximum value of ore/coke in a region including peripheral and middle parts when a sectional area of a throat is equally divided into central, middle and peripheral parts, $MIN(O/C)_{CE}$ is a minimum value of ore/coke in the central part, and $(O/C)_A$ is a predetermined ore/coke value;

changing the value of said index in accordance with the furnace operating conditions;

determining a charging pattern corresponding to the changed value of said index; and performing a furnace operation in accordance with the determined charging pattern.

3. A process according to claim 1, wherein said index is corelated to the following indices according to the following relational expressions when $\Delta(O/C)_{max}/(O/C)_A$ is x, $$(O/C)_W/(O/C)_A=0.122x^2+0.995$$

$$(O/C)_C/(O/C)_A=0.0625x^2-0.456x+0.985$$

$$\Delta(O/C)/(O/C)_A=0.99x+0.01$$

wherein $(O/C)_W$ is ore/coke at furnace wall, $(O/C)_C$ is ore/coke at furnace center and $\Delta(O/C)$ is $(O/C)_W-(O/C)_C$.

4. A process according to claim 1, wherein the burden distribution in the radial direction of the furnace is estimated, the process further comprising:

calculating from the estimated results of the burden distribution an index given by the following equation:

$$\Delta(O/C)_{max}/(O/C)_A=\{MAX(O/C)_A=\{MAX(O/C)_{P,M}-MIN(O/C)_{CE}\}/(O/C)_A$$

wherein $MAX(O/C)_{P,M}$ is a maximum value of ore/coke in a region including peripheral and middle parts when a sectional area of a throat is equally divided into central, middle and peripheral parts, $MIN(O/C)_{CE}$ is a minimum value of ore/coke in the central part and $(O/C)_A$ is a predetermined ore/coke value;

modifying the values of $\theta_1$ and $\theta_2$ on the basis of their found values which fluctuate in actual operation;

calculating the burden distribution and said index corresponding to said modified values of $\theta_1$ and $\theta_2$ for various charging patterns;

determining a charging pattern to make said index value constant; and successively performing a furnace operation in accordance with the determined charging pattern to always realize the constant burden distribution.

* * * * *